US009663199B2

(12) United States Patent
Curnutte et al.

(10) Patent No.: US 9,663,199 B2
(45) Date of Patent: May 30, 2017

(54) BOARD CARRIER

(71) Applicants: Paul Curnutte, Laguna Beach, CA (US); Jeremy R. Katz, Santa Monica, CA (US)

(72) Inventors: Paul Curnutte, Laguna Beach, CA (US); Jeremy R. Katz, Santa Monica, CA (US)

( * ) Notice: Subject to any disclaimer, the term of this patent is extended or adjusted under 35 U.S.C. 154(b) by 0 days.

(21) Appl. No.: 14/603,339

(22) Filed: Jan. 22, 2015

(65) Prior Publication Data

US 2017/0050705 A1 Feb. 23, 2017

(51) Int. Cl.

| | |
|---|---|
| ***A45F 3/15*** | (2006.01) |
| ***B63B 35/79*** | (2006.01) |
| ***A45F 5/02*** | (2006.01) |
| ***A45F 3/14*** | (2006.01) |

(52) U.S. Cl.

CPC ..... *B63B 35/7946* (2013.01); *A45F 3/14* (2013.01); *A45F 5/021* (2013.01); *A45F 2003/144* (2013.01)

(58) Field of Classification Search

CPC ..... A45F 5/021; A45F 3/15; B63B 35/7946
USPC ..... 224/268–270
See application file for complete search history.

(56) References Cited

U.S. PATENT DOCUMENTS

| | | | | |
|---|---|---|---|---|
| 603,538 | A | 5/1898 | Pettibone | |
| 2,651,441 | A | 9/1953 | Rau et al. | |
| 3,168,971 | A * | 2/1965 | Goertzen | F41B 5/1461 124/23.1 |
| 3,377,007 | A | 4/1968 | Gayler, Jr. | |
| 4,699,415 | A | 10/1987 | Skovajsa | |
| 4,724,989 | A | 2/1988 | Silberberg | |
| 4,804,025 | A | 2/1989 | Bear | |
| D321,792 | S | 11/1991 | MacNeary | |
| 5,158,510 | A | 10/1992 | Lemire | |
| 5,361,954 | A | 11/1994 | Tura | |
| 5,490,618 | A | 2/1996 | Davidson | |
| 5,582,338 | A | 12/1996 | Tamura | |
| 6,086,102 | A * | 7/2000 | Stark | A63C 11/026 224/917 |
| 6,857,673 | B2 * | 2/2005 | Lang | B65G 7/12 294/142 |

(Continued)

FOREIGN PATENT DOCUMENTS

| | | |
|---|---|---|
| AU | 2010101367 | 6/2011 |
| WO | 2007058552 | 5/2007 |

OTHER PUBLICATIONS

Economical SUP Storage Rack with Paddle Holder. Datasheet [online]. StoreYourBoard.com, 2012. <URL: http://blog.storeyourboard.com/2012/03/economical-sup-storage-rack-with-paddle.html> [See Enclosed PCT Search Report].

ACK Product Focus: Seattle Sports SupStow Bag. YouTube [online]. Austin Kayak, 2014. <URL: http://www.youtube.com/watch?v=MtMmjXdn-y4> [See Enclosed PCT Search Report].

(Continued)

*Primary Examiner* — Adam Waggenspack
(74) *Attorney, Agent, or Firm* — Myers Bernstein LLP

(57) ABSTRACT

A board carrier uses a belt configured for wearing around a person's waist. A hook bag in the belt has a downwardly facing entry with a closure. Proximal and distal ends of the hook are joined to the belt by length adjustable straps. The board is positioned within the hook with three-points of mutual contact between the board and the interior of the hook. The hook may have a spring clamp for securing a paddle. When not in use the hook and straps are placed within the hook bag.

14 Claims, 6 Drawing Sheets

(56) References Cited

U.S. PATENT DOCUMENTS

| | | | | |
|---|---|---|---|---|
| 7,175,061 | B2 * | 2/2007 | Dohn | A45F 5/02 224/241 |
| 7,543,726 | B2 | 6/2009 | MacNaughton | |
| 7,942,294 | B2 * | 5/2011 | Burton | A45F 3/14 224/162 |
| D640,052 | S * | 6/2011 | Benson | D3/254 |
| 2003/0164391 | A1 * | 9/2003 | Zwagerman | A45F 3/15 224/576 |
| 2004/0056060 | A1 | 3/2004 | Iannini | |
| 2005/0184118 | A1 * | 8/2005 | Vella | A45F 3/02 224/625 |
| 2008/0057804 | A1 * | 3/2008 | Watanabe | B63B 35/7946 441/74 |
| 2008/0185409 | A1 * | 8/2008 | Kellenberger | A45F 3/14 224/257 |
| 2009/0090754 | A1 | 4/2009 | Haberlein | |
| 2010/0187274 | A1 * | 7/2010 | Chock, Jr. | B63B 35/7946 224/578 |

OTHER PUBLICATIONS

Economical SUP Storage Rack with Paddle Holder. Datasheet [online]. StoreYourBoard.corn, 2012. <URL: http://blog.storeyourboard.com/2012/03/economical-sup-storade-rack-with-paddle.html> [See Enclosed PCT Search Report].

ACK Product Focus: Seattle Sports SupStow Bag. YouTube [online]. Austin Kayak, 2014. <URL: https://www.youtube.com/watch?v=MtMmjXdn-y4> [See Enclosed PCT Search Report].

SupN'Go. Datasheet [online]. SurfStow.com, 2014; <URL: http://web.archive.org/web/20141026023828/http://surfstow.com/transport.html> [See Enclosed PCT Search Report].

Economical SUP Storage Rack with Paddle Holder. Datasheet [online]. StoreYourBoard.com, 2012. <URL: http://blog.storeyourboard.com/2012/03/economical-sup-storade-rack-with-paddle.html> [See Enclosed PCT Search Report].

ACK Product Focus: Seattle Sports SupStow Bag. YouTube [online]. Austin Kayak, 2014. <URL: https://www. youtube.com/watch?v=MtMmjXdn-y4> [See Enclosed PCT Search Report].

* cited by examiner

BOARD CARRIER

RELATED APPLICATIONS

This application is related to provisional patent application U.S. 61/930,177 filed on Jan. 22, 2014, and claims international date priority thereof. This application describes a similar apparatus and method of use as presented in U.S. 61/930,177 and its subject matter is hereby incorporated herein by reference in its entirety.

BACKGROUND

The herein disclosed subject matter relates to the field of personally worn carriers and particularly to such carriers for surfboards, paddleboards, and the like.

For personally carrying ungainly or heavy objects, strap secured hooks are known as in U.S. Pat. No. 603,538 to Pettibone, U.S. Pat. No. 2,651,441 to Rau et al, U.S. Pat. No. 4,699,415 to Skovajsa, U.S. Pat. No. 5,361,954 to Tura, U.S. Pat. No. 5,490,618 to Davidson, U.S. Pat. No. 5,582,338 to Tamura, U.S. Pat. No. 7,543,726 to MacNaughton, US 2010/0187274 to Chock, Jr., Des. 321792 to MacNeary, and WO 2007/058552 to Winter; as well as sling mounts as in U.S. Pat. No. 3,377,007 to Gayler Jr., FR 2913891 to Cavallini, U.S. Pat. No. 4,804,025 to Bear, US 2004/0056060 to Iannini et al, US 2009/0090754 to Haberlein, and U.S. Pat. No. 4,724,989 to Silberberg. These devices are fastened by straps and harnesses to a person by waist, shoulder, chest, bandoleer, and various combinations of such connecting gear in order to distribute weight, free the hands, and provide other benefits of convenience and necessity. However, what is needed and not found in the prior art is a personal carrier for a paddleboard or surfboard that is quick and easy to position for use yet is easy to store conveniently when not in use, and will support an object of significant weight and size for portage. The presently described apparatus distinguishes over the prior art in a novel manner and fulfills this need.

SUMMARY

The following detailed description includes references to the accompanying illustrations which form a part of the detailed description. When carrying a board to and from a body of water: lake, ocean, or river, its weight and size requires a specialized carrier system to enable just one person to handle this task. In breezy conditions such as at the beach, the large surface area of a board may cause it to catch the wind and, again, be difficult to handle without a specialized carrier system, and, after dismounting the board from its carrier it is desirable to stow the carrier system on the person so that it doesn't interfere with riding the board. In summary, the carrier system should therefore be lightweight, relatively compact, easily stowed and inexpensive to manufacture. Example embodiments of the specialized carrier system are described herein in enough detail to enable those skilled in the art to practice the presented subject matter. However, once familiar with this disclosure it will be apparent to one of ordinary skill in the art that the present apparatus may be practiced without some of the presented specific details. In other instances, well-known methods, procedures and components may not be described in detail so as not to unnecessarily obscure aspects of the embodiments. The embodiments can be combined, other embodiments can be utilized or structural and logical changes can be made without departing from the scope of what is defined and claimed. The following detailed description is, therefore, not to be taken in a limiting sense, as the scope is defined by the appended claims and their equivalents which are to be understood in their broadest possible sense.

In this document, the terms "a" or "an" are used, as is common in patent documents, to include one or more than one. Furthermore, the term "or" is used to refer to a nonexclusive "or," such that "A or B" includes "A but not B," "B but not A," and "A and B," unless otherwise indicated.

BRIEF DESCRIPTION OF THE DRAWINGS

Embodiments of the described apparatus are illustrated by way of example in the figures of the accompanying drawing sheets, in which like references indicate the same or similar elements shown and in which.

DETAILED DESCRIPTION

Disclosed in FIGS. 1A, 1B, and 2-6 are aspects of a board carrier, herein "carrier 10." As discussed previously carrier 10 is an advanced apparatus for manually carrying a board 20, and is especially useful for porting a paddleboard and paddle, or a stand-up surfboard known as a longboard. Today such boards 20 may have a medial width of from about 26 to 36 inches, and an overall length of up to 14 feet. The medial thickness of board 20 may be between about 3 and 8 inches and may weigh between about 10 and 25 pounds. Boards 20 are typically transported to water locations by vehicles and then carried or ported to and from the water's edge manually. Such an object is difficult to carry any significant distance or over rough terrain or steep grades due to its weight, and size. When breezes are present a manually carried board 20 may be difficult to handle due to wind forces on their surface areas especially when held vertically; see FIG. 1.

Figure 1A:
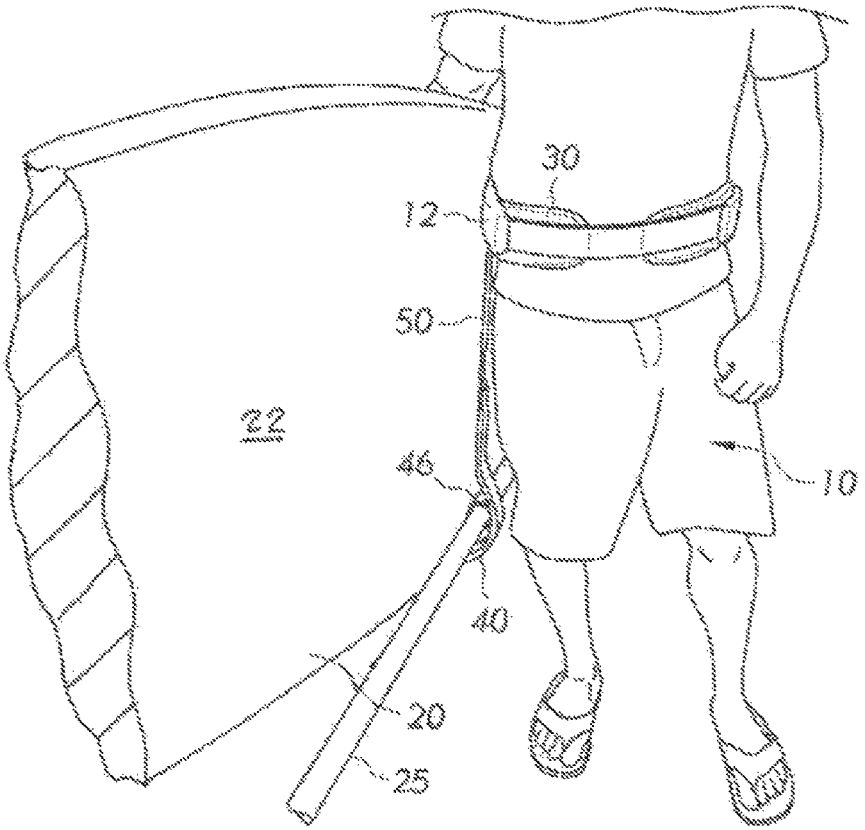
FIG. 1A is a front perspective view of board and paddle as mounted in a board carrier for porting.
Figure 1B:
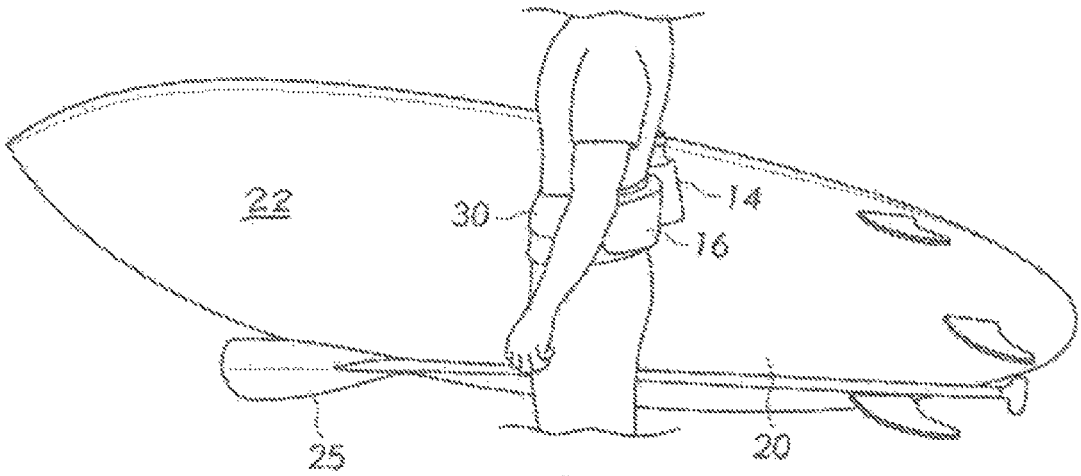
FIG. 1B is right side view thereof.
Figure 2:
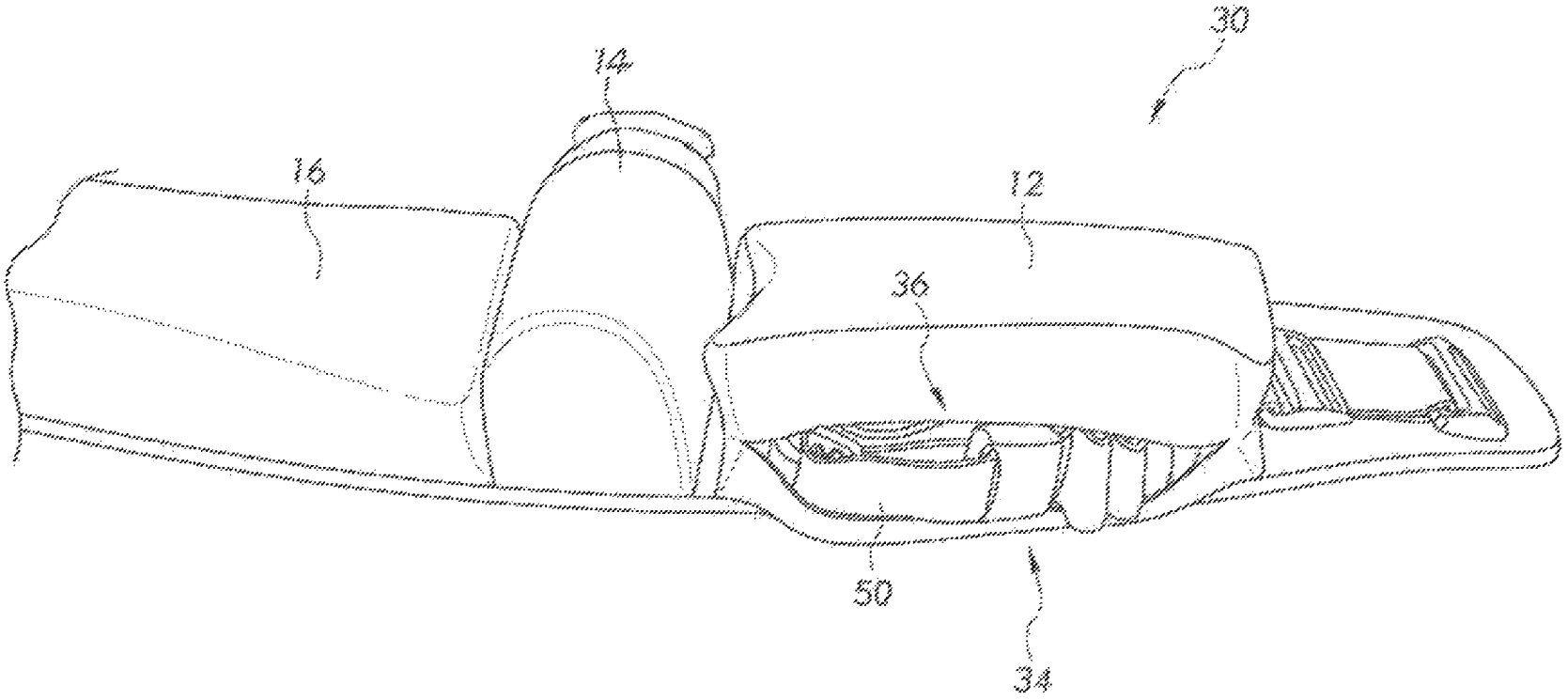
FIG. 2 is a partial bottom perspective view of a belt thereof.

As shown in FIGS. 1A and 1B, carrier 10 may include a belt 30 of Cordura® or similar fabric sewn around a molded foam portion and may have a nylon backing, whereas this construction provides strength, durability and comfort. A hook bag 12, water bottle holder 14 and gear bag 16 or other pockets or pouches may be attached to belt 30 and may be made of ripstop nylon or similar material for flexibility and durability.

Configured for wearing around the waist of a paddle boarder, or surfboard rider belt 30 is to be worn around the waist as shown in FIGS. 1A and 1B. Belt-hook bag 12 may be in the form of a pouch, see FIG. 2, with a downwardly facing entry 34 including a closure 36 such as a zipper, Velcro® strips, spring mounted flaps, or otherwise.

Figure 3:
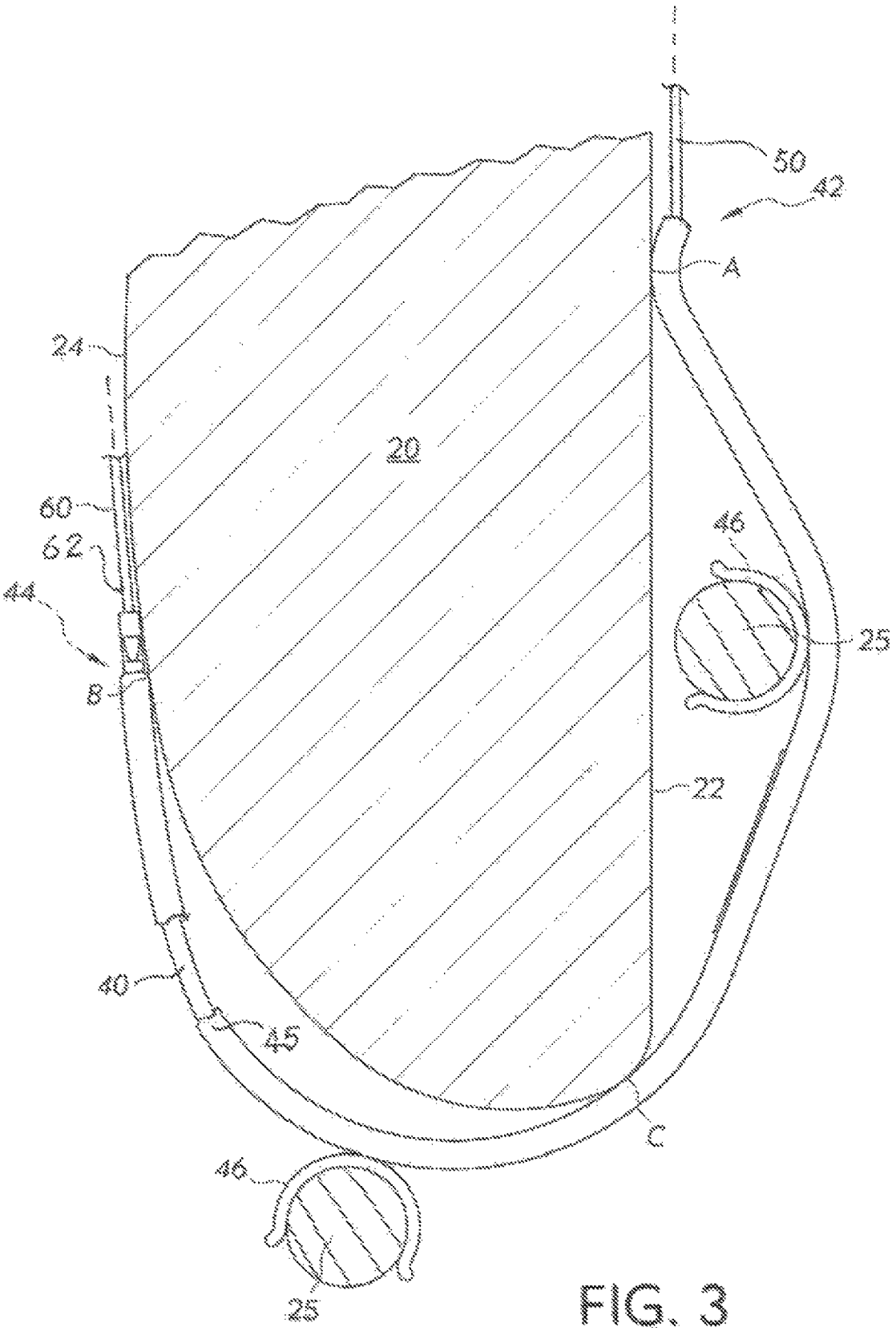
FIG. 3 is an elevation view of a hook thereof showing a portion of a board as inserted therein with proximal and distal straps supporting the hook and showing paddles clamped to the hook.
Figure 4:
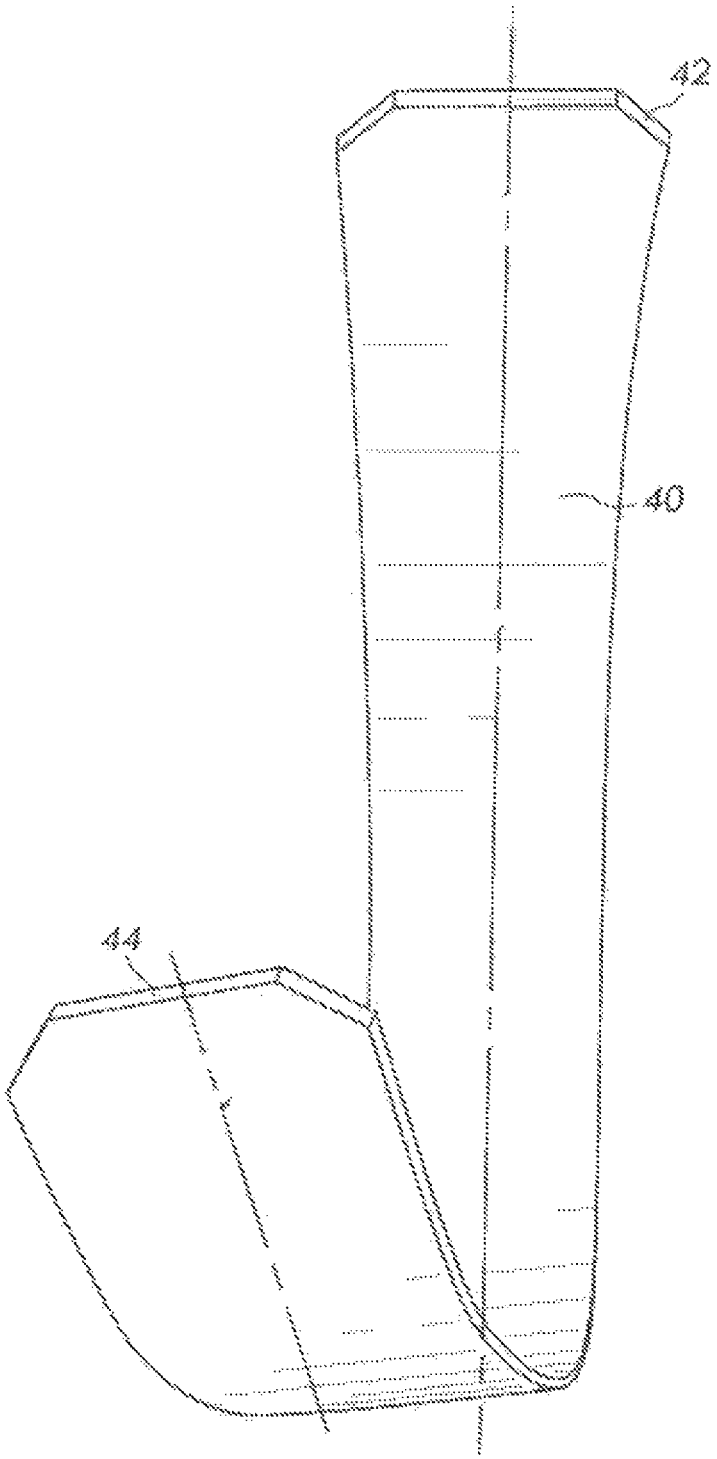
FIG. 4 is a perspective view of a twisted hook thereof.
Figure 5:
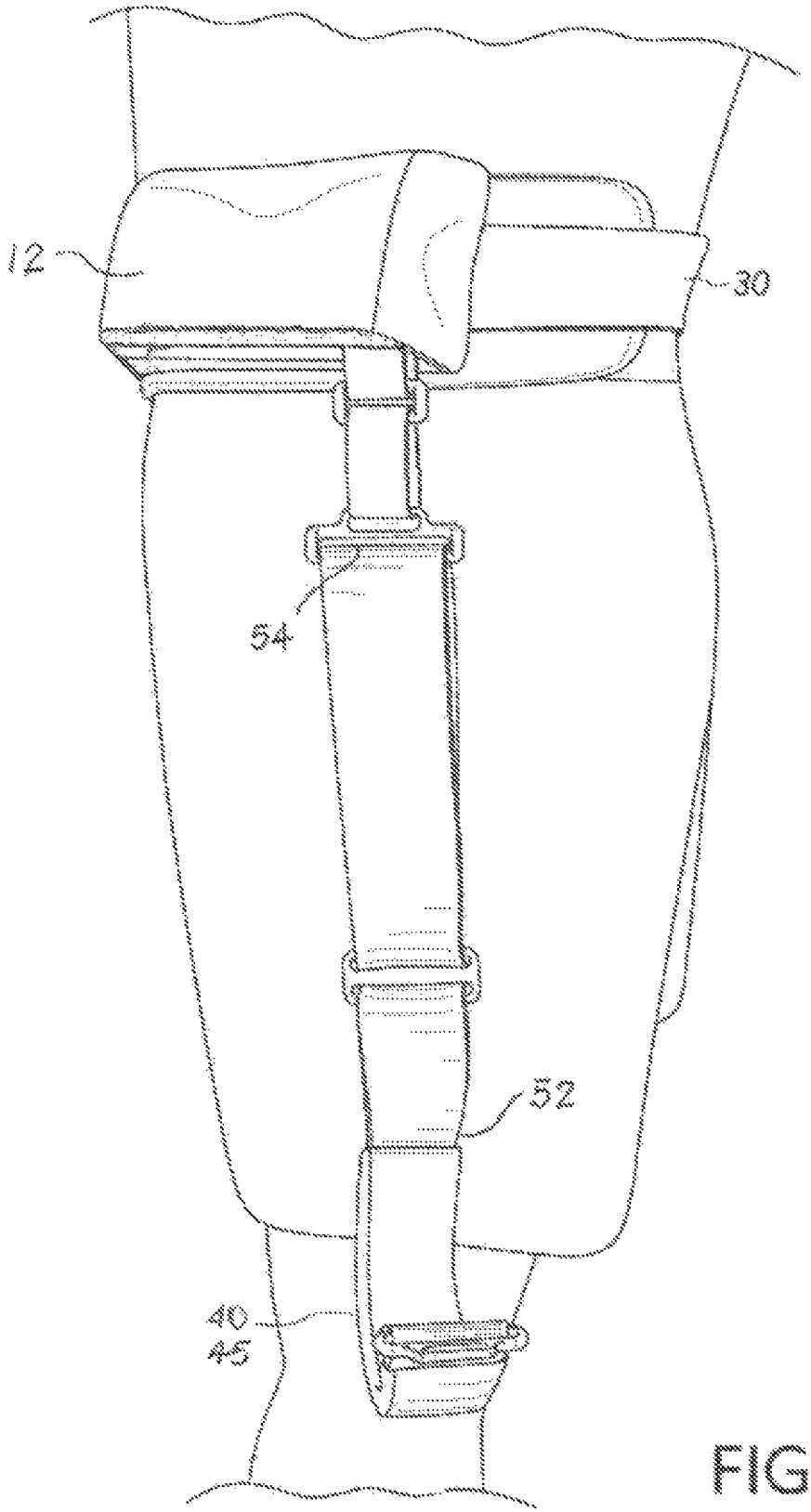
FIG. 5 is a perspective view of the belt and hook thereof as fully deployed.
Figure 6:
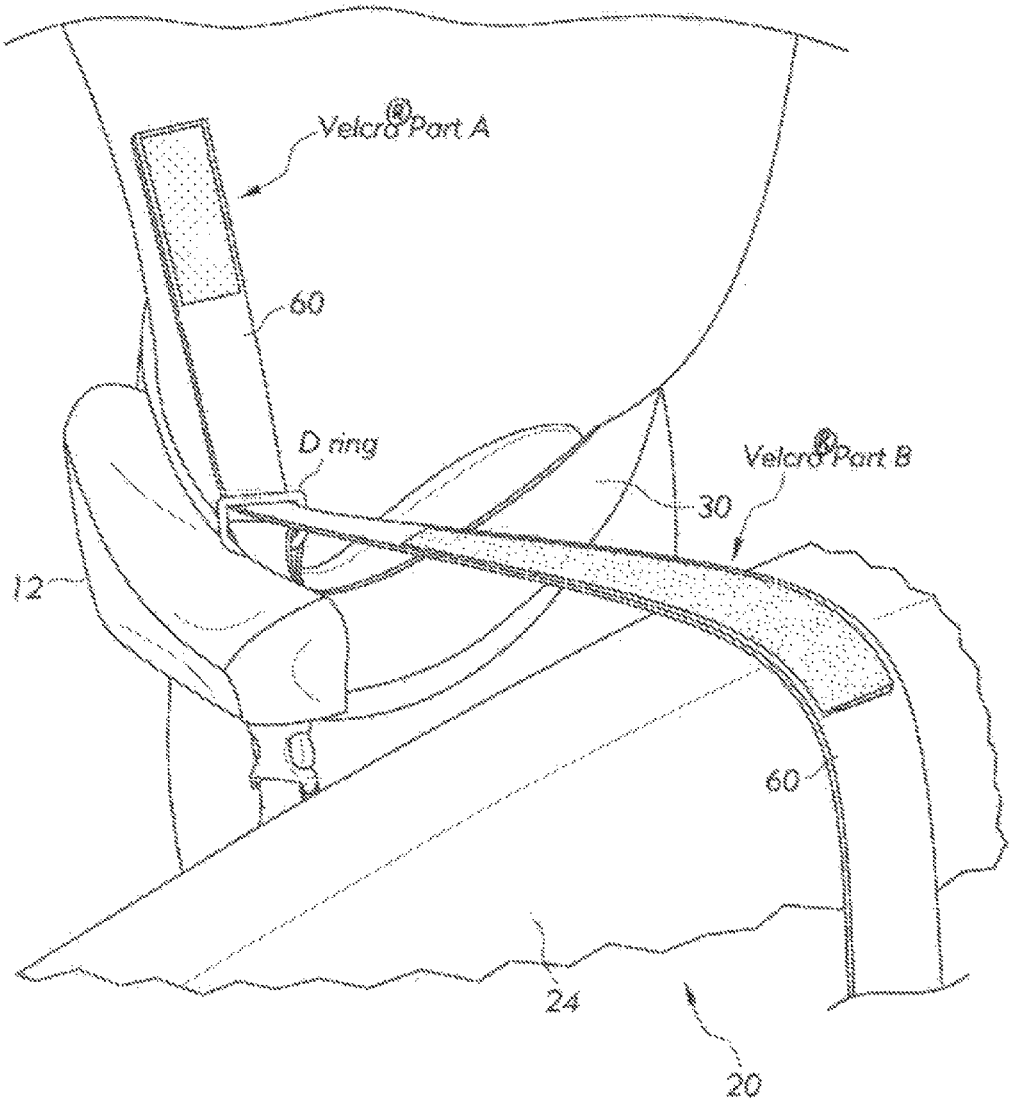
FIG. 6 is a perspective view of the distal strap as folded over the board and engaged through a ring of the belt in the process of being pulled tight.

Carrier 10 may also include a U-shaped hook ("hook 40") which may have a modified contour as shown in FIG. 3 wherein a proximal end 42 is spaced apart from a distal end 44 and ends 42 and 44 may be aligned laterally across hook 40, or they may be misaligned or mutually twisted as shown in FIG. 4. Both aligned and twisted versions of hook 40 provide for advantageous support of board 20. Hook 40 may have a width of up to about 5 inches so that it may provide a stable support surface for board 20 while also fitting neatly within hook bag 12. Hook 40 may be covered by a sleeve 46 (shown in FIGS. 1A, and 6) of Cordura material or equal and may have a neoprene or rubber insert sewn inside for cushioning as well as to increase sliding friction against board 20. Proximal end 42 may be joined to a proximal, length-adjustable strap 50 at a first end 52, while a second end 54 may be fixed within hook bag 12 by stitching, riveting, or by clamps, snaps, or other means. Hook 40 therefore may be positioned directly below hook bag 12 hanging by strap 50 as shown in FIGS. 1A and 5. Lower end 52 of strap 50 may be stiff and shaped as shown in FIG. 3 so as to force hook 40 away from the leg of the individual thus preventing mutual contact with the leg and hook 40 and making it easier to drop board 20 into hook 40. Depending on the location of hook bag 12, board 20 may be carried on the left side or on the right side of an individual. It is noted in FIG. 1A that board 20 is carried with its bottom surface 22 facing the individual carrying it. This is advantageous since the bottom surface 22 is either essentially flat or slightly concave; a reasonable fit against the side contour of an individual. Another advantage is that there is usually a hand-hold on the top surface 24 of board 20 within reach of the individual's hand so that placing an arm over board 20, as shown in FIG. 1A, and placing a hand in said hand hold can provide manual control of the attitude of board 20 especially when traversing a grade or stairs. A further advantage is that the fin or fins normally found on the bottom of board 20 are facing toward the individual carrying board 20 so there is less chance of an inadvertent contact of these relatively sharp fins with other individuals passing by as board 20 is carried to and from the water. Hook 40 may receive board 20 therein with no more than three-points of mutual contact between board 20 and hook 40 as shown in FIG. 3, i.e. points "A," "B," and "C." This is advantageous since with this three-point posture the weight of board 20 causes hook 40 to move away from the individual's leg. A distal, length-adjustable strap 60 may be attached at one end 62 to distal end 44 of hook 40 while a further end of strap 60, shown in FIG. 6 may be attached to belt 30 with adjustability in strap tension so that it is clear that distal, length-adjustable strap 60 may be lashed tightly over board 20 providing for hands-free carrying of board 20. In an embodiment, hook 40 may have an integral hinge 45 such as a "living hinge," for instance whereby tightening of distal strap 60 causes hook 40 to grip board 20.

Hook 40 is positionable over a vertical range of 24 inches by adjustments of length-adjustable straps 50 and 60 wherein this range of vertical adjustment enables carrier 10 to be used by both short as well as tall individuals. Straps 50 and 60 may be made of heavy duty dive/scuba belt webbing material and may be up to 3 inches in width providing lateral stability to board 20.

As shown in FIGS. 1A and 3, hook 40 may have attached thereto a spring clip 46 which may exert a strong clamping force on a paddle 25 to hold it in place in parallel attitude to paddleboard 20.

Hook 40 may be fabricated by bending metal strip material having a spring temper, or by injection-molding of a plastic or rubber or a combination compound so as to selectively provide for a spring flexibility. In this case proximal and distal ends of hook 40 may be flexibly-tensed apart when inserting board 20 so that compressive clamping forces are applied to board 20 to improve the holding power of hook 40 on board 20.

In the foregoing description, embodiments are described as a plurality of individual parts, and this is solely for the sake of illustration. Accordingly, it is contemplated that some additional parts may be added, some parts may be changed or omitted, and the order of the parts may be re-arranged, without leaving the sense and understanding of the apparatus as claimed.

What is claimed is:

1. A carrier for a board comprising:

a belt configured for wearing around a waist of a person, said belt having a hook bag with a downwardly facing entry;

a board hook, comprising:

a bend, a first length, and a second length;

a board receiving gap being defined by the first length, the bend, and the second length;

the first length including a proximal portion attached to a length-adjustable strap with the opposite end of the length-adjustable strap attached to said belt, and a second bend formed between the proximal portion and the bend;

the second bend being curved such that a central portion of the second bend extends away from the second length, and a clip for attaching a paddle thereto positioned on the central portion; and said board hook configured for receiving said board therein with no more than three-points of mutual contact therebetween.

2. The carrier of claim 1 wherein said entry of said hook bag includes a closure thereof.

3. The carrier of claim 1 wherein said board hook is positionable over a vertical range of about 20 inches.

4. The carrier of claim 1 wherein said first length and said second length of said board hook are vertically aligned.

5. The carrier of claim 1 wherein said first length and said second length of said board hook are vertically misaligned.

6. The carrier of claim 1 wherein said board hook is of a flexible material.

7. The carrier of claim 6 wherein said first length and said second length of said board hook are compressively flexed apart when receiving said board.

8. A combination board and carrier for said board, the combination comprising:

a belt configured for wearing around a waist of a person, said belt having a hook bag with a downwardly facing entry;

a board hook, comprising:

a spiral bend, a first length, and a second length, said spiral bend angling the second length relative to the first length;

a board receiving gap being defined by the first length, the spiral bend, and the second length;

the first length including a proximal portion attached to a length-adjustable strap with the opposite end of the length-adjustable strap attached to said belt, and a second bend formed between the proximal portion and the spiral bend; and the second bend being curved such that a central portion of the second bend extends away from the second length.

9. The carrier of claim 8 wherein said entry of said hook bag includes a closure thereof.

10. The carrier of claim 8 wherein said board hook is positionable over an adjustment range of 24 inches.

11. The carrier of claim 8 wherein said board hook further has a clip supporting a paddle.

12. The carrier of claim 8 wherein said board hook is of a spring temper flexible material.

13. The carrier of claim 12 wherein said first length and said second length of said board hook are flexed apart when said board is received in said board hook, said first and second lengths thereby exerting a compressive force on said board.

14. The carrier of claim 8 wherein said board hook has an integral hinge wherein said second length of said board hook is movable toward and away from said first length of said board hook.

* * * * *